US006045060A

United States Patent [19]

Hudson

[11] Patent Number: 6,045,060

[45] Date of Patent: Apr. 4, 2000

[54] LIQUID SOAP MIXER FOR SHOWERHEADS

[76] Inventor: Donald D. Hudson, 49 Goshen St., New London, Conn. 06320

[21] Appl. No.: 09/250,244

[22] Filed: Feb. 12, 1999

Related U.S. Application Data

[63] Continuation-in-part of application No. 08/820,751, Mar. 19, 1997, abandoned.

[51] Int. Cl.[7] ..... B05B 7/26

[52] U.S. Cl. ..... 239/310; 239/311; 239/316

[58] Field of Search ..... 239/310, 311, 239/316

[56] References Cited

U.S. PATENT DOCUMENTS

| | | | |
|---|---|---|---|
| 3,083,915 | 4/1963 | Grauel | 239/310 |
| 3,628,732 | 12/1971 | Vicari | 239/310 |
| 4,189,100 | 2/1980 | Karp | 239/310 |
| 4,623,095 | 11/1986 | Pronk | 239/311 |
| 5,071,070 | 12/1991 | Hardy | 239/311 |
| 5,454,516 | 10/1995 | Smyrl | 239/310 X |

*Primary Examiner*—Lesley D. Morris
*Assistant Examiner*—Robin O. Evans
*Attorney, Agent, or Firm*—Donald D. Hudson

[57] ABSTRACT

The present invention is a Continuation-In-Part (CIP) of the originally filed U.S. Pat. application Ser. No. 08/820,751, and relates to the plumbing industry and more specifically to the personal showering portion of that industry, in which the device of the present invention is installed between the existing shower water delivery pipe and whatever showerhead the user may choose. The device of the present invention includes a liquid soap angled inlet elbow, screw in holding means on the top of the angled liquid soap inlet elbow to hold a standard liquid soap bottle with a on-off valve closure that releases the liquid into the water stream. The liquid soap is released by merely lifting the standard soap bottle which opens the on-off valve closure, the soap is introduced into the shower water stream coming from the water delivery pipe by a venturi effect and gravity flow. The position of the soap inlet elbow is designed to hold the inverted liquid soap bottle in a relatively upright position to allow for gravity and a venturi effect flow of the soap into the delivery pipe water stream, so the user may enjoy a very sudsy shower after which the user merely pushes down on the standard soap bottle to stop the flow of soap into the delivery pipe water stream to rinse off and to clean out the present invention and showerhead simultaneously.

6 Claims, 1 Drawing Sheet

LIQUID SOAP MIXER FOR SHOWERHEADS

Titles the present device within this Patent (CIP) Application of my original application Ser. No. 08/820,751 filed on Mar. 19, 1997 as Liquid Soap mixer for Showerheads, noe abandoned.

BACKGROUND OF THE INVENTION

The device of the present invention is a continuation in part (CIP) of my original application Ser. No. 08/820,751 filed Mar. 19, 1997. Devices for attempting to mix soap with water flow in a shower to produce a sudsy showerhead discharge, are well known in the art. None have been successful because of internal valves, hoses and suction lines clogging and being very complicated, difficult to use and expensive to manufacture.

The following is the present state of the art, none of the cited patents disclose or even suggest the novel device disclosed herein. Nowhere is there a showing of the gravity and venturi effect flow or the unique angled soap delivery elbow for the upright liquid soap bottle and the screwed in the holding means for the bottle's external push-pull or on-off valve closure in the screw in holding means.

U.S. Pat. No. 3,207,445 issued to F.W. Court, et al. on Sep. 21, 1965, entitled Shower Bathing Device, which shows a soap-water mixing device that draws soap out of a soap receptical and has a myirad of valves and mixing devices.

U.S. Pat. No. 3,231,200 issued to J. I. Heald on Jan. 25, 1966, entitled Shower Head and Liquid Soap Dispensing and Metering Means, which shows another soap-water mixing device that draws soap up out of a receptical and has tubes and user on/off valves.

U.S. Pat. No. 3,628,732 issued to V. Vicari on Dec. 21, 1971, entitled Soap Mixer and Dispenser for Shower Bath and the Like, which shows the use of a cake of soap that is inserted in a soap container that mixes with water through a series of valves to make soapy water.

U.S. Pat. No. 4,998,836 issued to M. Scripneck on Mar. 12, 1991, entitled Venturi Line Operated Soap Brush, which shows a soap valving dispensing unit that is attached to the shower wall and delivers soapy water to a shower head.

U.S. Pat. No. 5,135,173 issued to W. M. Cho on Aug. 4, 1992, entitled Multiple adjustable Faucet Device, which shows a very complicated and expensive device that has two separate tanks, one for shampoo and the other for liquid soap. This device requires a pull chain to operate a switch from one tank to the other tank and requires a suction arrangement to mix the liquid soap or shampoo with water.

OBJECT OF THE PRESENT INVENTION

An object of the present invention is to provide a liquid soap shower mixing device that operates simply by gravity combined with a venturi effect.

A further object of the present invention is to provide a liquid soap mixing device that is free of the danger of clogging as in valve systems.

An additional object of the present invention is to provide a liquid soap mixing device that eliminates suction lines and internal hoses and internal valves.

A still further object of the present invention is to provide a liquid soap mixing device that will allow the use of commercially available liquid soaps having the standard push-pull or on-off valve closure with a screw-in holding means.

Still another object of the present invention is to provide a liquid soap mixing device that is flexible enough to be used with any shower head or handheld unit.

SUMMARY OF THE INVENTION

The present invention overcomes all of the undesirable problems that are inherent in the soap-water mixing devices for personal showering of the prior art. In addition to its novel structure, the present invention allows the user to purchase his own soap and use the bottle that it comes in as part of the device. The user has nothing to do but to invert the bottle and slip it into the screwed in holding means on top of the angled soap delivery elbow. The screw in holding means and the angled elbow is so designed to hold a standard push-pull or on-off soap bottle closure valve and hold it in a relative upright position to facilitate gravity flow of the liquid soap. The push-pull or on-off valve closure merely slips into the fitted cavity and holds it in place so that when the bottle is lifted the push-pull or on-off valve closure opens and allows the soap to flow. This makes this invention very economical to maker, sell, and use.

The device of the present invention fits between the shower water delivery pipe and any standard shower head. The screw in holding means is merely screwed onto the top of the angled soap delivery elbow.

The entrance end of the device of the present invention is attached to the water delivery pipe and the shower head is connected to the exit end. The soap bottle is slipped into the cavity of the holding means and the user is ready to go. The bottle is merely lifted which opens the valve closure and gravity and a venturi effect introduces soap into the water stream.

DETAILED DESCRIPTION OF THE PREFERRED EMBODIMENT OF THE PRESENT INVENTION

Figure 1:
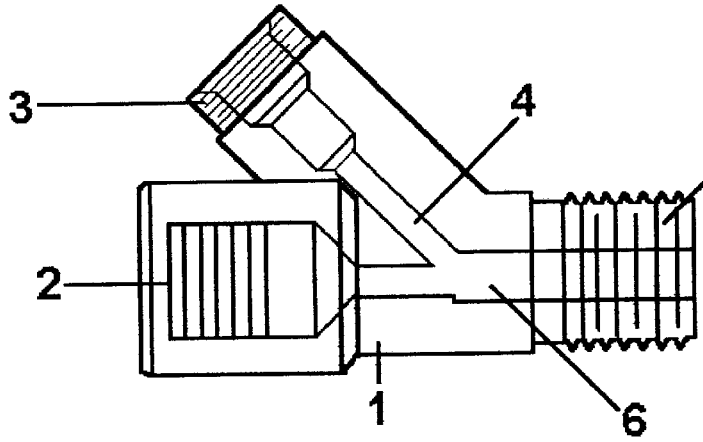
FIG. 1 is a cross-sectional view of the device of the present invention, showing the various parts of the invention without the cylindrical screw-in holding means attached thereon.
Figure 2:
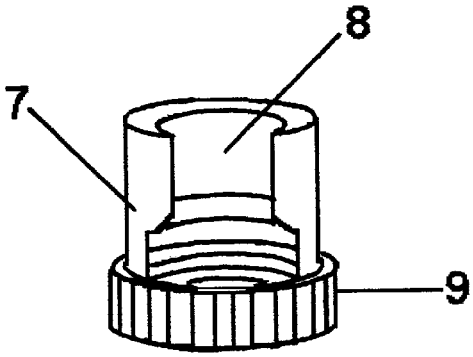
FIG. 2 is a perspective view of the cylindrical screw-in soap bottle support means of the present invention.

Referring to the drawing wherein FIG. 1 shows a shower mixing device 1 with an internal venturi design for the shower water delivery pipe connector 2 where the water enters the device. The delivery pipe has a standard on-half inch-threaded connection. The other end of the device has a threaded one-half inch-threaded connection for attaching a showerhead or a hand held with a flexible pipe. The water entrance end of the device has female threads which allows the unit to be connected directly to the water delivery pipe projecting through the wall. The other end of the device is provided with an elbow having an angled soap delivery passage 4 and having a threaded portion 3 for attaching bottle retaining nut 7, as shown in FIG. 2. The water passing through the water delivery pipe is mixed with soap exiting from the soap inlet channel 4 to form a water and soap mixture that exits out of channel 6.

Figure 3:
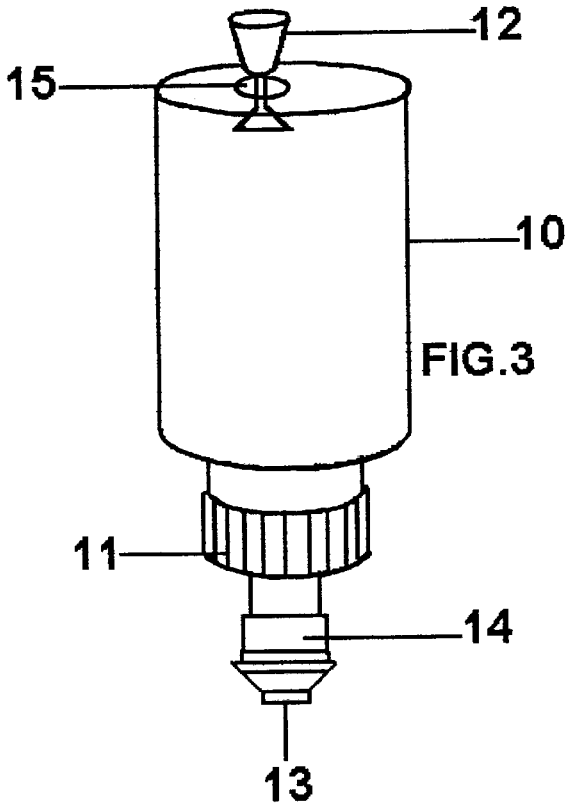
FIG. 3 is a perspective plan view of a clear refill bottle for easy viewing of contents level with the typical push-pull or on-off valve closure and a fill and vent plug thereof.

Referring now to FIG. 2, which shows a cylindrical slotted bottle retaining nut 7 having a channel or cavity 8 and is provided with a threaded part 9 for attaching to the threaded portion 3 of the elbow. A clear plastic bottle 10, as seen in FIG. 3, is provided for it's lightweight and safety, as well as for easy viewing of the soap level area. The bottle is cylindrical and is inverted and placed in the cavity 8 in the retaining nut 7 which is screwed on the angled elbow of the device shown in FIG. 1. A bottle 10 is provided with an on-off valve 14 for discharging the contents of the liquid soap bottle to mix with the water passing through the water delivery pipe. Consequently, the sudsing mixture of water and soap is discharged through soap discharge hold 13. The inverted soap bottle is provided with a fill and vent plug 12, as well as an anti-collapse vent hole 15. The latter allows air to enter the bottle as soap is being discharged and in order to prevent the collapse of the bottle. The on-off valve 14 can be activated in order to discharge liquid soap into the water stream in order to form the liquid soap mixture.

In operation, the present liquid soap bottle is placed in the cavity 8 of the slotted bottle retaining nut 7 for holding the liquid soap bottle in its position. In order to utilize the device, the liquid soap bottle 10 and nut 7 are placed in a relatively upright position and screwed into the threaded portion of the angled elbow. When the on-off valve 14 is activated, the soap mixture passes by gravity through soap inlet channel 4 and mixes with delivery water and the mixture exits out of the exit channel 6 of the shower mixing device. Thus, a person utilizing the shower is provided with a soap and water mixture, as desired.

While the invention has been disclosed and described with reference to a single embodiment, it will be apparent that variations and modifications may be made therein and it is therefore intended in the following claims and modifications as falls within the true spirit and scope of the invention.

What I claim as my invention is:

1. A soap and water mixing device comprising an elongated body having a passage for water therein, and provided with an angled elbow having a passage for liquid soap attached to the surface of said elongated body and communicating with said water passage, a bottle retaining nut having a channel, a liquid soap bottle being inverted and positioned in the channel of said bottle retaining nut having a soap discharge hole and means on said nut for removable connecting said nut and soap bottle to said angled elbow, said bottle in it's inverted position being provided with a bottle closure member on the top thereof, and an on/off valve in said bottle closure member which is activated to open and shut said closure member when positioned in said bottle retaining nut and said liquid soap bottle is pulled up or pushed down thereby causing soap to mix with the water exiting out of a standard showerhead or handheld unit.

2. A soap and water mixing device as claimed in claim 1 further provided with a hole at one end of said bottle closure for discharging and metering said soap and a hole at the opposite end of said bottle constituting a fill and vent plug.

3. A soap and water mixing device as claimed in claim 1 wherein said elongated body is tubular.

4. A soap and water mixing device as claimed in claim 3 wherein said tubular water mixing device provided with one and a half inch female pipe threads to connect to a standard water delivery pipe.

5. A soap and water mixing device as claimed in claim 1 wherein said liquid soap bottle is fabricated of clear plastic in order to observe the soap level in said bottle.

6. A soap and water mixing device as claimed in claim 3 wherein said tubular water mixing device provided with one and a half inch male pipe threads to connect to a standard showerhead or handheld unit.

* * * * *